US007188813B2

(12) United States Patent
Kollar

(10) Patent No.: US 7,188,813 B2
(45) Date of Patent: Mar. 13, 2007

(54) ADJUSTABLE SUPPORT ASSEMBLY

(75) Inventor: Kevin J. Kollar, Ada, MI (US)

(73) Assignee: Knape & Vogt Manufacturing Company, Grand Rapids, MI (US)

( * ) Notice: Subject to any disclaimer, the term of this patent is extended or adjusted under 35 U.S.C. 154(b) by 79 days.

(21) Appl. No.: 11/147,065

(22) Filed: Jun. 6, 2005

(65) Prior Publication Data

US 2006/0273228 A1 Dec. 7, 2006

(51) Int. Cl.
*E04G 3/00* (2006.01)

(52) U.S. Cl. ..... 248/279.1; 248/285.1; 248/918

(58) Field of Classification Search ..... 248/278.1, 248/279.1, 282.1, 284.1, 283.1, 285.1, 918, 248/920

See application file for complete search history.

(56) References Cited

U.S. PATENT DOCUMENTS 4,616,798 A 10/1986 Smeenge et al.
5,037,054 A * 8/1991 McConnell ..... 248/284.1
5,145,136 A 9/1992 McConnell
5,257,767 A * 11/1993 McConnell ..... 248/284.1
5,292,097 A 3/1994 Russell
5,294,087 A 3/1994 Drabczyk et al.
5,398,622 A 3/1995 Lubinskas et al.
5,487,525 A 1/1996 Drabczyk et al.
5,791,263 A * 8/1998 Watt et al. ..... 108/138
5,836,560 A 11/1998 Kaplan et al.
5,924,664 A 7/1999 Mileos et al.
5,924,666 A * 7/1999 Liu ..... 248/286.1
5,975,474 A 11/1999 Kaplan et al.
6,027,090 A * 2/2000 Liu ..... 248/281.11
6,098,935 A 8/2000 Kaplan et al.
6,116,557 A 9/2000 Choy et al.
6,135,404 A 10/2000 Wisniewski et al.
6,135,405 A 10/2000 Jones et al.
6,173,934 B1 1/2001 Lin
6,176,456 B1 1/2001 Wisniewski
6,186,460 B1 2/2001 Lin
6,199,809 B1 3/2001 Hung
6,227,508 B1 5/2001 Panzarella et al.
6,257,538 B1 7/2001 Pangborn et al.
6,270,047 B1 8/2001 Hudson
6,273,382 B1 8/2001 Pemberton
6,279,859 B2 8/2001 West et al.
6,322,031 B1 11/2001 LeClair et al.
6,336,617 B1 1/2002 Barber et al.
6,336,618 B1 1/2002 Barber
6,397,763 B1 6/2002 Panzarella et al.
6,398,176 B1 6/2002 Liu
6,409,127 B1 6/2002 VanderHeide et al.
6,450,467 B2 9/2002 Timm
6,460,816 B1 10/2002 Barber
6,523,797 B2 2/2003 LeClair et al.

(Continued)

*Primary Examiner*—Ramon O Ramirez
(74) *Attorney, Agent, or Firm*—Mayer, Brown, Rowe & Maw LLP

(57) ABSTRACT

An adjustable support assembly for a data entry/interface device provides selective adjustment of the height of a data entry/interface mount with respect to a work surface mount. The adjustable support assembly also may provide for selective adjustment of the angular orientation or tilt of the data entry/interface mount. A selective height adjustment device is provided with a releasable brake assembly to permit control of the height of the data entry/interface mount, while selective angular orientation of the data entry/interface mount may be achieved by use of a clamping assembly.

20 Claims, 5 Drawing Sheets

U.S. PATENT DOCUMENTS 6,527,235 B1 * 3/2003 Cotterill ..... 248/118.3
6,533,229 B1 3/2003 Hung
6,565,055 B1 5/2003 Timm
6,598,844 B2 7/2003 Barber
6,601,812 B2 8/2003 LeClair et al.
6,726,168 B2 * 4/2004 Barber ..... 248/284.1
7,004,438 B2 * 2/2006 Lin ..... 248/289.11
2002/0158179 A1 * 10/2002 Barber ..... 248/424
2004/0195482 A1 * 10/2004 Kollar et al. ..... 248/282.1
2004/0262477 A1 * 12/2004 Whitaker et al. ..... 248/284.1
2005/0092884 A1 * 5/2005 Lin ..... 248/285.1
2005/0224671 A1 * 10/2005 Lin ..... 248/289.11

* cited by examiner

ADJUSTABLE SUPPORT ASSEMBLY

BACKGROUND OF THE INVENTION

1. Field of the Invention

The present invention relates to adjustable support assemblies for attachment to a work surface for adjustably supporting a data entry or other interface device adjacent and with respect to the work surface. More particularly, this invention relates to an adjustable support assembly for selective adjustment of the height of the interface device with respect to the work surface to which it is mounted. An additional clamp assembly may be incorporated to adjust the angular orientation or tilt of the support assembly.

2. Discussion of the Prior Art

It is widely known to use a support assembly to support a computer keyboard or other data entry or interface device, with the support assembly mounted on the underside of a work surface often adjacent to a computer screen. Such assemblies allow the keyboard or similar device to rest on a support platform and be adjusted for height and/or angular orientation with respect to the work surface to ergonomically accommodate a user. They also commonly provide for movement to a storage position under the work surface, so that the interface device is moved out of the way for other tasks in the proximity of the work surface when the interface device is not in use.

Prior art keyboard support assemblies often have disadvantageous features or structures. Many use screw-type friction clamps for both height and tilt adjustment. These assemblies tend to be simple but require awkward and time consuming two-handed manipulation. Once the appropriate angular orientation of the support platform is set, the height of the support assembly is not able to be quickly adjusted with one hand. Yet, it is important to be able to make rapid height adjustments of the support platform in an efficient manner without also requiring or disturbing adjustment of the angular orientation at the same time. This is commonly needed when desiring to quickly move the support assembly downward and then slide it beneath the work surface to be out of the way and in its storage position.

Other prior art devices use complicated systems involving pressurized cylinders or cable systems to position a support platform for height and/or tilt adjustment. Such devices may have an overly limited range of adjustment, or may have a tendency toward loss of effectiveness over time, necessitating repair and/or replacement of the components. In addition, such assembles are considerably more complicated, making them more expensive due to the higher cost of these components.

While prior art assemblies have worked adequately for their intended purposes, because of the demands on many users of data entry and interface devices, there is a need for improved independent control of the height and tilt adjustments. The present invention provides a solution for these needs by including separately operable, simple, cost effective controls, with the more frequently needed height adjustment being accomplished with one hand of the user.

SUMMARY OF THE INVENTION

The present invention provides an adjustable support assembly for attachment to a work surface to support an interface device for computers or the like such as a keyboard, keypad, laptop, notebook computer, personal data/digital assistant, tablet PC, trackball or the like, and which includes an adjustment assembly for adjusting the height of the support platform relative to the work surface. The invention provides an assembly that permits release and adjustment of the height of the support platform with respect to the work surface using only one hand. In addition, a clamp assembly may be used to allow for adjustment of the angular orientation of the support platform.

In a first form of the present invention, an adjustable support assembly for attachment to a work surface to support a data entry/interface device is provided, with the support assembly having a data entry/interface mount, a work surface mount, and a linkage assembly connected to the data entry/interface mount and to the work surface mount. The adjustment assembly has a releasable brake assembly adapted to permit selective adjustment of the height of the data entry/interface mount relative to the work surface mount wherein when the brake assembly is in a clamping position it does not resist upward movement of the data entry/interface mount but prevents downward movement thereof, and when the brake assembly is in a release position it permits downward movement of the data entry/interface mount, wherein the releasable brake assembly further comprises a slide bar which engages an aperture in a brake plate member with the brake plate member being movable from the clamping position to the release position of the slide bar upon upward tilting of a leading edge of the data entry/interface mount. The adjustment assembly of the adjustable support assembly may further have a clamp assembly adapted to permit selective adjustment of the angular orientation of the data entry/interface mount relative to the work surface mount by selective engagement of a clamp releasably applied to maintain the position of an axis through a portion of the linkage assembly relative to a position on the data entry/interface mount.

In another form of the present invention, an adjustable support assembly for attachment to a work surface to support a data entry/interface device is provided, the support assembly having a data entry/interface mount, a work surface mount, a linkage assembly connected to the data entry/interface mount and to the work surface mount, and an adjustment assembly for adjusting the height and angular orientation positions of the data entry/interface mount on the linkage assembly with respect to the work surface mount. The adjustment assembly has a releasable brake assembly having a slide bar which engages an aperture in a brake plate member wherein the brake plate member is movable from a clamping position to a release position upon upward tilting of a leading edge of the data entry/interface mount to permit the slide bar to slide in either direction through the aperture in the slide plate member. The adjustment assembly also has a clamp assembly adapted to permit selective adjustment of the angular orientation of the data entry/interface mount relative to the work surface mount by clamping the data entry/interface mount in a selected position relative to the linkage assembly.

In a preferred embodiment of the adjustable support assembly, a rotatable knob is coupled to one portion of the linkage assembly and includes a clamp movable between clamping and release positions upon selective rotation of the knob. When rotated to the release position, the operator may adjust the angular orientation or tilt of the data entry/interface mount on which a support platform and an interface device may be located. Once the clamp has been applied to maintain the angular orientation, a linkage assembly is arranged to engage and pivot a brake plate member to a release position upon tilting upward the forward edge of the support platform. The brake plate member resists movement of a slide bar in at least one direction to resist downward movement of the platform support mount when in the clamping position.

Further, the height adjustment assembly includes a biasing element engaging the brake plate member and a housing. The biasing element urges the brake plate member into the clamping position with respect to the slide bar that engages an aperture through the brake plate member. In addition, the linkage assembly has a second biasing element that urges the platform support mount toward a raised position to assist the user in moving the support platform.

The preferred embodiment of this invention allows independent control of the height and tilt of the data entry/interface mount for the support platform on which typically rests the interface device, and it also allows adjustment of the fore and aft location and directional orientation of the data entry/interface mount. The tilt is controlled with the conveniently positioned rotary knob. The height is controlled by grasping and tilting upward the forward edge of the platform support with a single hand to achieve a release position, and then using the same hand to push the support downward. The same single hand can be used to slide the adjustable support assembly from a position under the work surface to a position extended out forward of the work surface. The angular orientation of the support also may be reoriented relative to the forward edge of the work surface by side-to-side movement of the support, within a horizontal plane, relative to a rotary mounting of the work surface mount. Indeed, a single hand can be used to simultaneously control the height, fore and aft, and angular orientation positions, if desired.

Thus, the present invention presents an alternative to the more complicated or more cumbersome to operate prior art devices. The present invention simplifies the height and angular orientation adjustment mechanisms to more readily accommodate the common needs of users.

It is to be understood that both the foregoing general description and the following detailed description are exemplary and provided for purposes of explanation only, and are not restrictive of the invention, as claimed. These and other objects, advantages, purposes and features of the present invention will become more apparent from a study of the following description of the preferred embodiment, taken in conjunction with the drawings and the appended claims.

BRIEF DESCRIPTION OF THE DRAWINGS

In describing the preferred embodiment, reference is made to the accompanying drawing figures wherein like parts have like reference numerals, and wherein.

It should be understood that the drawings are not to scale. While considerable mechanical details of an adjustable support assembly, including details of fastening means and other plan and section views of the particular components have been omitted, such details are considered well within the comprehension of those skilled in the art in light of the present disclosure. It also should be understood that the present invention is not limited to the preferred embodiment illustrated.

DETAILED DESCRIPTION OF THE PREFERRED EMBODIMENT

Referring generally to FIGS. 1–8, it will be appreciated that the adjustable support assembly of the present invention may be embodied within various configurations. As presented now in greater detail, an adjustable support assembly 10 is shown in FIGS. 1–8 and is adapted for attachment to the underside of a work surface such as a desk, credenza, shelf or the like to support a keyboard or other data entry/interface device for a computer or the like in a position adjacent to a computer, computational device, microprocessor, CPU (central processing unit) for a computer, or the like or a computer monitor or screen for use by the user of the data entry/interface device. The adjustable support assembly 10 provides the ability to change the height of the support platform P for the data entry/interface device with respect to the work surface W so that a keyboard or other data entry/interface device (not shown) mounted on the support platform P, which may include further auxiliary support surfaces, may be raised and lowered with respect to the work surface to accommodate the height of the hands of a user sitting adjacent thereto. The invention also may be configured to permit a user to change the angular orientation or tilt of the support platform P by rotation of the support platform P as shown by the arrows A in FIG. 2.

As used herein data entry/interface device shall be understood to include devices used by operators to input data, control or otherwise interact with a computer, PC (personal computer), computational device, microprocessor, CPU (central processing unit) for a computer, or the like. Such data entry/interface devices include, for example, keyboards, keypads, laptop/notebook computers, PDA's (personal data/digital assistant), tablet PC's (personal computers), trackball controls or trackballs, or the like.

Figure 1:
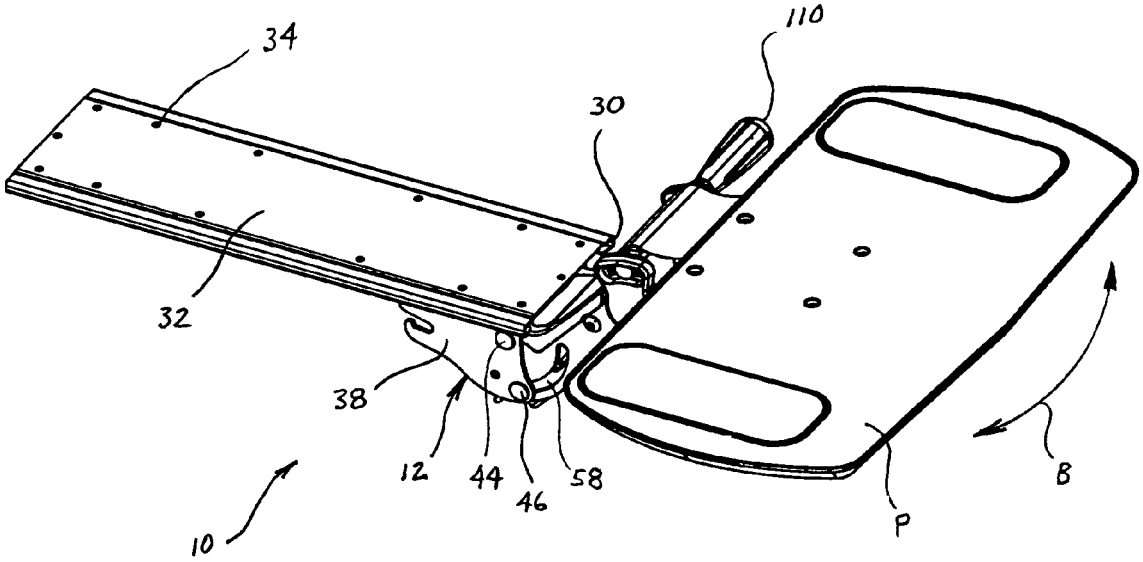
FIG. 1 is a perspective view of the adjustable support assembly of the present invention including a data entry/interface support platform and a work surface mounting plate.
Figure 2:
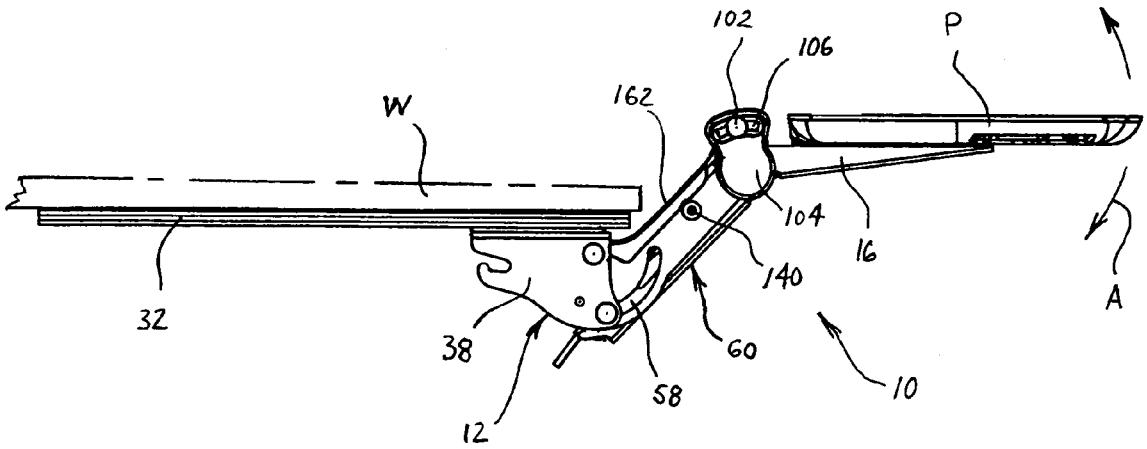
FIG. 2 is a side elevation of the adjustable support assembly of the present invention when secured to the underside of a work surface shown in phantom and supporting a data entry/interface support platform in a fully raised position.
Figure 3:
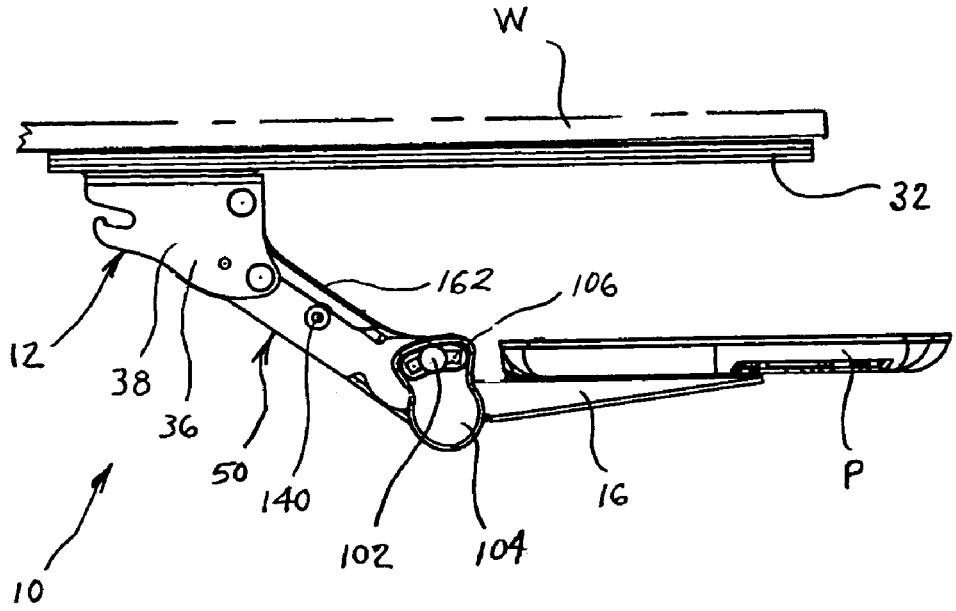
FIG. 3 is a side elevation of the adjustable support assembly of the present invention when secured to the underside of a work surface shown in phantom and supporting a data entry/interface support platform in a fully lowered and retracted storage position.
Figure 4:
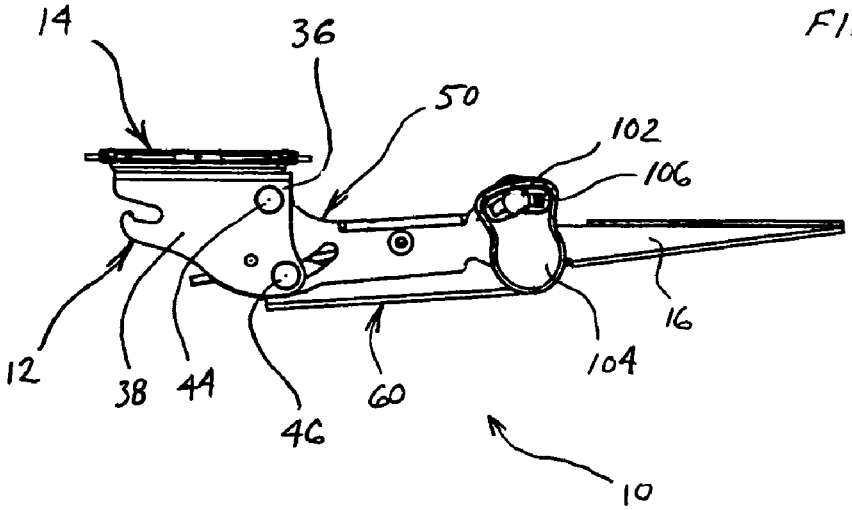
FIG. 4 is a side elevation of the adjustable support assembly of the present invention without the work surface mounting plate and the data entry/interface support platform shown in FIG. 3, and in an intermediate position.
Figure 5:
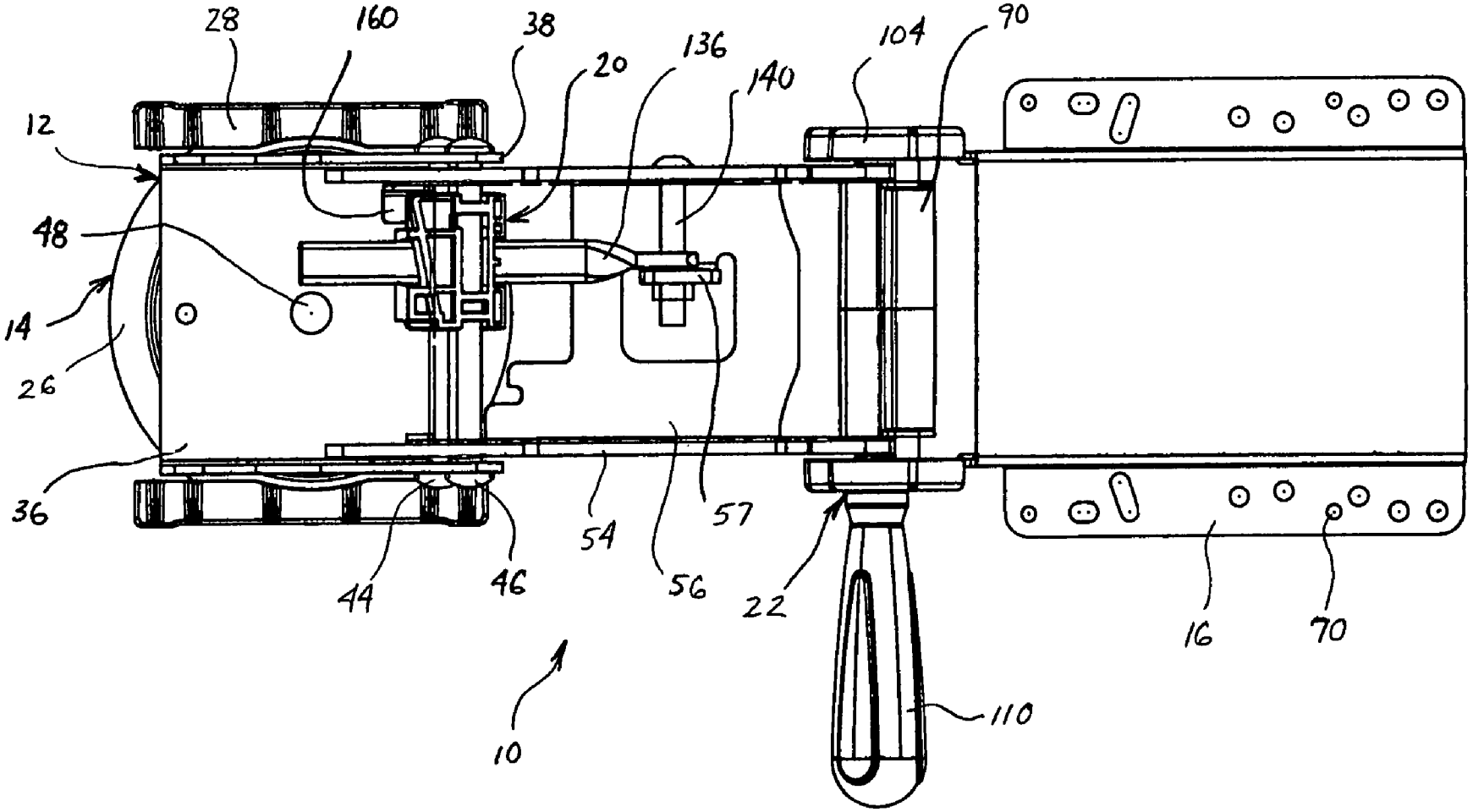
FIG. 5 is a bottom plan view of the adjustable support assembly of the present invention.
Figure 6:
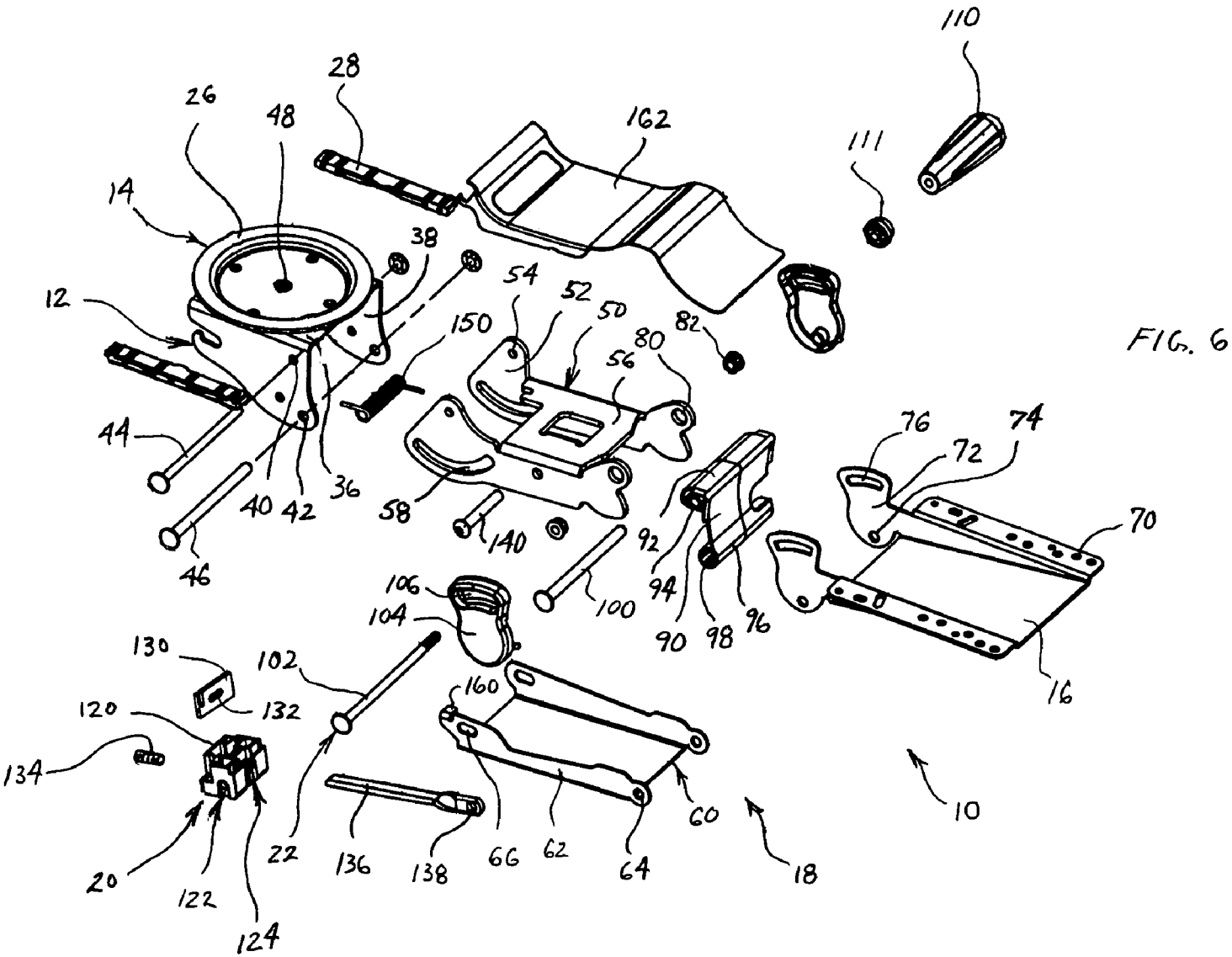
FIG. 6 is an exploded perspective view of the adjustable support assembly of the present invention.
Figure 7:
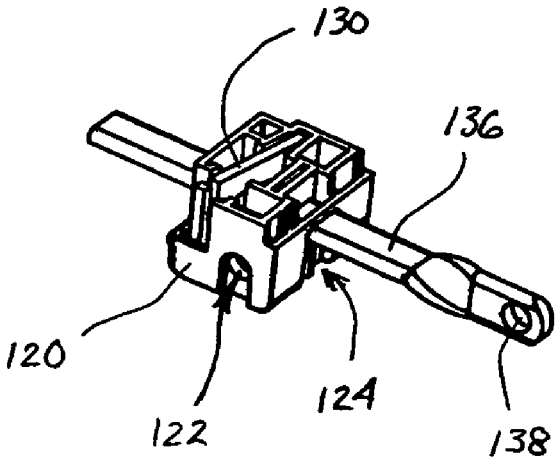
FIG. 7 is a perspective view of the height adjustment brake assembly.
Figure 8:
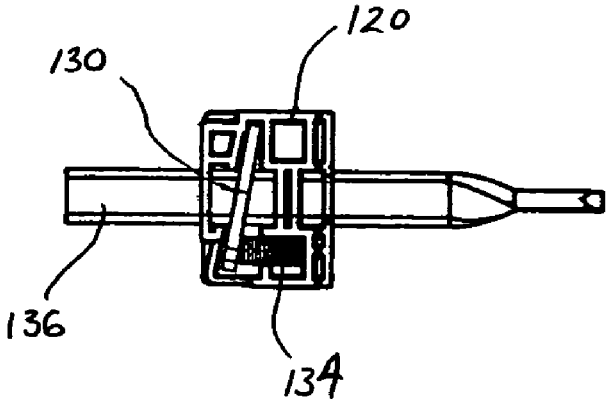
FIG. 8 is a bottom view of the height adjustment brake assembly shown in FIG. 7.

In the preferred embodiment, adjustable support assembly 10 includes a work surface mount 12 shown with an optional swivel assembly 14, best seen in FIGS. 4 and 6, which enables the data entry/interface device to be mounted to the underside of a work surface and pivoted in a horizontal plane in the directions shown by the double-headed arrow B in FIG. 1, regardless of the height of the support assembly. As best seen in FIGS. 2–6, adjustable support assembly 10 also includes support platform mount 16, alternatively referred to hereinafter as a data entry/interface mount 16, for the mounting of a platform support P upon which will be located a keyboard or other data entry/interface device. The adjustable support assembly 10 also includes a linkage assembly 18 which adjustably connects work surface mount 12 to data entry/interface mount 16, and an adjustment assembly described in more detail below for selectively adjusting the height and angular tilt positions of the data entry/interface mount on the linkage assembly with respect to the work surface mount.

The adjustment assembly has a releasable brake assembly 20 that permits selective adjustment of the height of the data entry/interface mount 16 relative to the work surface mount 12, as will be described herein in more detail. In the preferred embodiment, the adjustment assembly also has a clamp assembly 22 that permits selective adjustment of the angular orientation of the data entry/interface mount 16 relative to the work surface mount 12, as will be described herein in more detail. However, it will be understood and is contemplated that selective adjustment of the angular orientation of the data entry/interface mount may be achieved by use of other clamp assemblies. For instance, one may use other clamp assemblies that will be incorporated by reference and serve as examples of other usable clamp assemblies, such as those disclosed in U.S. Pat. Nos. 6,565,055 and 6,460,816; or in U.S. patent application Ser. No. 10/695,146, to selectively adjust the angular orientation or tilt.

As is best seen in FIGS. 5 and 6, swivel assembly 14 includes a swivel plate 24 having a rim or outer flange 26 that fits within a pair of spaced apart plastic slide guides 28 such that the slide guides 28 extend above and below the outer flange 26. Slide guides 28 are slidingly received in inwardly opening channel portions 30 of elongated bracket 32, shown in FIG. 1. Bracket 32 is adapted to be fastened to the underside of work surface W by known attachment means such as by screws passing through apertures 34 and into the body of work surface W, or by other conventional fasteners or the like. When swivel plate 24 and its slide guides 28 are slidingly received in channel portions 30 of elongated bracket 32, swivel plate 24 can be slid forwardly and rearwardly along and under work surface W such that the entire adjustable support assembly 10 can be moved rearwardly to a storage position beneath work surface W, as shown in FIG. 3, or moved forwardly for access to the keyboard or other data entry/interface device as shown in FIGS. 1 and 2.

Pivotally mounted beneath swivel plate 24 is a swivel bracket 36 having a pair of spaced, downwardly extending side flanges or side walls 38 having aligned pairs of circular apertures 40, 42 for receiving fasteners 44, 46 respectively, such as headed rods, bolts and nuts or other conventional fasteners or the like, for pivotal support of linkage assembly 18 as will be described below more fully. Swivel bracket 36 is pivotally secured to swivel plate 24 for rotational movement by means of a fastener 48 extending through aligned apertures in swivel plate 24 and swivel bracket 36. A friction reducing nylon or other plastic disc or other suitable washers of metallic or other materials may be interposed therebetween for smooth pivotal movement. As with the clamp assembly for tilt adjustment, it will be understood that the swivel assembly shown in the preferred embodiment is just one of the potential swivel assemblies that could be utilized with the invention.

With reference to FIGS. 5 and 6, linkage assembly 18 includes an upper link arm 50 and a lower link arm 60. Upper link arm 50 includes side walls 52 having aligned apertures 54 in rearward, generally triangular portions of side walls 52. Side walls 52 of upper link arm 50 are connected by a web 56 extending therebetween and having a perpendicular flange 57 extending downward therefrom and parallel to side walls 52. The rearward portion of side walls 52 include lower, aligned arcuate slots 58. Lower link arm 60 has upwardly extending side walls 62 with aligned apertures 64 at the forward end and aligned slots 66 at the rearward ends of side walls 62. Side walls 62 of lower link arm 60 are disposed between side walls 52 of upper link arm 50. The rearward end of side walls 52 of upper link arm 50 are, in turn, disposed between downwardly extending side walls 38 of swivel bracket 36.

Data entry/interface mount 16 is adapted to be fastened to the underside of support platform P by known attachment means such as by screws passing through apertures 70 and into the body of support platform P, or by other conventional fasteners or the like. Data entry/interface mount 16 has a pair of spaced, upwardly extending side walls 72 having a lower aligned pair of apertures 74 and an upper aligned pair of arcuate slots 76.

The forward portion of side walls 54 of upper link arm 50 include enlarged apertures 80 which receive spacers 82 therein, and which are disposed between side walls 72 of data entry/interface mount 16. The forward portion of side walls 62 of lower link arm 60, with their apertures 64, are disposed between side walls 72 of data entry/interface device 16.

A front shroud 90 has an upper portion 92 having a bore 94 therethrough, and a lower portion 96 having a bore 98 therethrough and being parallel to bore 94. Upper portion 92 of front shroud 90 is disposed between spacers 82 while lower portion 96 is disposed between side walls 62 of lower link arm 60.

Upper link arm 50 is pivotally coupled at its rearward end to work surface mount 12 by fastener 44 which passes through apertures 40 in side walls 38 of swivel bracket 36 and through apertures 54 in side walls 52 of upper link arm 50. Upper link arm 50 also is coupled at its forward end to work surface mount 12 and lower link arm 60 by fastener 46 which passes through apertures 42 in side walls 38 of swivel bracket 36, slots 66 in side walls 62 of lower link arm 60 and arcuate slots 58 of side walls 52 of upper link arm 50.

Lower link arm 60 also is pivotally coupled at its forward end to data entry/interface mount 16 and front shroud 90 by fastener 100 which passes through apertures 74 in side walls 72 of data entry/interface mount 16, apertures 64 in side walls 62 of lower link arm 60 and bore 98 in front shroud 90.

In the preferred embodiment, clamp assembly 22 includes fastener 102 which couples side shrouds 104 to upper link arm 50 at its forward end, data entry/interface mount 16 and front shroud 90. Fastener 102 passes through arcuate slots 106 in side shrouds 104, arcuate slots 76 in side walls 72 of data entry/interface mount 16, spacers 82 in apertures 80 of side walls 54 of upper link arm 50, and bore 94 in front shroud 90. Spacers 82 act as bushings to allow upper link arm 50 to pivot freely despite engagement of clamp assembly 22. Fastener 102 of clamp assembly 22 may be a threaded bolt or the like. The user may selectively adjust the angular orientation of the data entry/interface mount 16 with respect to the remainder of the adjustable support assembly 10, and thereby the work surface W to which the assembly is mounted, by apply a compressive load to achieve clamping between the data entry/interface mount 16 and the front shroud 90 by means of a rotatable knob 10, lever or the like, which is adapted to threadably engage fastener 102. By rotating the knob 10 to release clamp assembly 22, the user may select the angle at which the support platform will be held, and then rotate knob 110 to engage clamp assembly 22 to retain that angular position. Also, an optional tilt indicator 111 with an aperture therethrough may be received on fastener 102, adjacent rotatable knob 110.

Releasable brake assembly 20 provides for selective adjustment of the height of the data entry/interface mount 16 relative to the work surface mount 12. Releasable brake assembly 20 includes a housing 120 having a first bore 122 therethrough which receives fastener 46 thereby pivotally coupling housing 120 to work surface mount 12. Housing 120 also has a second bore 124 perpendicular to and spaced from first bore 122. A brake plate 130 having an aperture 132 therethrough is received in brake housing 120 along with biasing element 134. Second bore 124 and aperture 132 in brake plate 130 receive a slide bar 136 therethrough. Slide bar 136 has an aperture 138 through its forward end, and is pivotally mounted to upper link arm 50 at an aperture in perpendicular flange 57 by fastener 140. Aperture 132 is sized to permit slide bar 136 to move freely through aperture 132 when brake plate 130 is in a release position, substantially perpendicular to slide bar 136.

Biasing element 134 may be of any suitable structure and is shown in the preferred embodiment as a coil spring which is disposed within housing 120 toward one end of brake plate 130, to tend to force brake plate 130 into a braking or clamped position, away from a position that would be substantially perpendicular to slide bar 136. In the braking or clamped position, slide bar 136 is permitted to move through brake plate 130 in a first direction, which corresponds to raising the data entry/interface mount 16 relative to work surface mount 12, but lockingly engages slide bar 136 to resist its movement in the opposite direction, which corresponds to lowering data entry/interface mount 16 relative to work surface mount 12.

At rest, the adjustable support assembly 10 has braking plate 130 in a braking or clamped position, biased by biasing element 134 away from a position that is perpendicular to slide bar 136, thereby resisting downward movement of the data entry/interface mount 16 and hence support platform P. The magnitude of resistance to downward motion is a matter of design choice, but should be sufficient to prevent downward movement when a user merely leans on support platform P. In the braking or clamped position, data entry/interface mount 16 and platform P are permitted to be raised by simply lifting them upward. Indeed, a torsion spring 150 with a rectilinear arm at each end may be used to provide assistance in lifting the support platform P relative to the work surface W. Such a spring 150 may have fastener 46 pass therethrough and its opposing arms may engage work surface mount 14 and upper link arm 50 to apply a force that tends to assist in the lifting of support platform P, to counterbalance the added weight of a data entry/interface device.

To permit the user to move brake plate 130 to a release position to lower the data entry/interface mount 16 relative to work surface mount 12, tab 160 is provided proximate the rearward end of lower link arm 60. Tab 160 is adapted to be positioned adjacent brake plate 130, on the opposite side of brake plate 130 relative to biasing element 134. Slots 66 at the rearward end of lower link arm 60 receive fastener 46, and with the adjustable support assembly 10 at rest, fastener 46 will be at the forward end of slots 66. However, if a user lifts the support platform P at its leading or forward edge, so as to tilt it slightly upward relative to its position at rest, lower link arm 60 will be pulled forward until fastener 46 engages the rearward end of slots 66. This limited range of motion is sufficient to permit tab 160 on lower link arm 60 to engage and move brake plate 130 to its release position, substantially perpendicular to slide bar 136. In such release position, slide bar 136 is free to move in either direction through aperture 124 in brake plate 130, thereby removing the resistance to downward movement of support platform P. Thus, in the release position of brake assembly 20, the user may raise or lower the data entry/interface mount 16 relative to the work surface mount 12, within a range of motion provided by the sliding movement of fastener 46 within aligned arcuate slots 58 in sides 52 of upper link arm 50 relative to the fixed position of fastener 46 in aligned apertures 42 in side walls 38 of swivel plate 36 of work surface mount 12.

The act of a user to slightly tilt support platform P and then push it downward while continuing to hold it in a slightly tilted position can be achieved with one hand operation, as can the act of simply raising the support platform P. Given that most users tend to select and maintain a given angular orientation of a data entry/or interface device, such simplicity of structure and ease of adjusting the height of the support platform P while maintaining a preselected angular orientation or tilt of the support platform P make the present invention particularly advantageous. Thus, for example, a user may select the appropriate angular orientation and maintain it by engaging the clamp assembly 22. Then, with one hand, the support platform P for the data entry/interface device may be freely moved from a storage position forward and upward to a use position. Similarly, the support platform P may be moved to a release position of brake assembly 20 with one hand by slightly tilting it upward at its forward edge to permit it then to be moved downward and rearward to return it to a storage position, which will be maintained upon release of the support platform P. In this manner, a user may separately adjust the height and tilt of data entry/interface mount 16, and thereby of support platform P relative to work surface mount W, to achieve a variety of convenient positions for storage or use.

It should be understood that it is further advantageous to use shrouds in conjunction with devices such as the present invention, for protection of the user against potential injury, for protection of the device from abuse or an undesirable environment, and/or for aesthetic enhancement of the adjustable support assembly. In this regard, in the preferred embodiment, front shroud 90 and side shrouds 104 already have been identified. A further top shroud 162 is shown for potential use in the present invention to conceal the upper portions of the assembly so as to reduce the likelihood of pinching hazards and to enhance the appearance of the device. The slide guides 28, shrouds 90, 104 and 162, and housing 120 for brake assembly 20 typically would be constructed of molded plastics. Knob 110 typically would have a threaded metal insert and a plastic and/or rubber outer covering. Most or all of the remaining parts typically would be fabricated from steel or aluminum.

It will be appreciated that an adjustable support assembly in accordance with the present invention may be provided in various configurations. Any variety of suitable materials of construction, configurations, shapes and sizes for the components and methods of connecting the components may be utilized to meet the particular needs and requirements of an end user. It will be apparent to those of skill in the art that various modifications can be made in the design and construction of such an adjustable support assembly without departing from the scope or spirit of the present invention, and that the claims are not limited to the preferred embodiment illustrated.

The invention claimed is:

1. An adjustable support assembly for attachment to a work surface to support a data entry/interface device, said support assembly comprising:

a data entry/interface mount;

a work surface mount;

a linkage assembly connected to the data entry/interface mount and to the work surface mount; and an adjustment assembly comprising a releasable brake assembly adapted to permit selective adjustment of the height of the data entry/interface mount relative to the work surface mount wherein when the brake assembly is in a clamping position it does not resist upward movement of the data entry/interface mount but prevents downward movement thereof, and when the brake assembly is in a release position it permits downward movement of the data entry/interface mount, wherein the releasable brake assembly further comprises a slide bar which engages an aperture in a brake plate member with the brake plate member being movable from the clamping position to the release position of the slide bar upon upward tilting of a leading edge of the data entry/interface mount.

2. The adjustable support assembly of claim 1, wherein the adjustment assembly further comprises a clamp assembly adapted to permit selective adjustment of the angular orientation of the data entry/interface mount relative to the work surface mount by selective engagement of a clamp releasably applied to maintain the position of an axis through a portion of the linkage assembly relative to a position on the data entry/interface mount.

3. The adjustable support assembly of claim 2, wherein the clamp assembly comprises a fastener having a longitudinal axis and passing through a portion of the data entry/interface mount and through a portion of the linkage assembly, and further comprises a rotatable member which is adapted to threadably engage the fastener to apply a clamp along the longitudinal axis of the fastener.

4. The adjustment support assembly of claim 2, wherein the clamp assembly is adapted to releasably apply a clamp which permits pivotable movement of the data entry/interface mount about said axis through said portion of said linkage assembly.

5. The adjustment support assembly of claim 2, wherein the clamp assembly is adapted to permit selective adjustment of the angular orientation of the data entry/interface mount relative to the work surface mount by selective engagement of a clamp releasably applied to maintain the position of an axis through a portion of the linkage assembly relative to a position along an arcuate slot in the data entry/interface mount.

6. The adjustment support assembly of claim 1, wherein the slide bar is pivotally coupled to the linkage assembly.

7. The adjustment support assembly of claim 1, wherein and the brake plate member is located in a housing, the housing being pivotally coupled to the work surface mount.

8. The adjustment support assembly of claim 7, wherein the brake plate member and a biasing member are located in the housing and the biasing member is adapted to bias the brake plate member to the clamping position.

9. The adjustment support assembly of claim 8, wherein a portion of the linkage assembly is adapted to engage the brake plate member upon upward tilting of the leading edge of the data entry/interface mount.

10. The adjustment support assembly of claim 9, wherein the swivel assembly of the work surface mount slidably engages a work surface mounting bracket for movement of the data entry/interface mount toward and away from the work surface mount.

11. The adjustment support assembly of claim 1, wherein the work surface mount further comprises a swivel assembly for pivotal movement of the data entry/interface mount within a horizontal plane.

12. The adjustment support assembly of claim 1, wherein a biasing member engages the work surface mount and the linkage assembly to assist a user in moving the data entry/interface mount upward, or while lowering the data entry/interface mount after moving the releasable brake assembly to the release position.

13. An adjustable support assembly for attachment to a work surface to support a data entry/interface device, said support assembly comprising:

a data entry/interface mount;

a work surface mount;

a linkage assembly connected to the data entry/interface mount and to the work surface mount;

an adjustment assembly for adjusting the height and angular orientation positions of the data entry/interface mount on the linkage assembly with respect to the work surface mount;

the adjustment assembly comprising a releasable brake assembly having a slide bar which engages an aperture in a brake plate member wherein the brake plate member is movable from a clamping position to a release position upon upward tilting of a leading edge of the data entry/interface mount to permit the slide bar to slide in either direction through the aperture in the slide plate member; and the adjustment assembly further comprising a clamp assembly adapted to permit selective adjustment of the angular orientation of the data entry/interface mount relative to the work surface mount by clamping the data entry/interface mount in a selected position relative to the linkage assembly.

14. The adjustment support assembly of claim 13, wherein when the brake assembly is in a clamping position it does not resist upward movement of the data entry/interface mount but prevents downward movement thereof, and when the brake assembly is in a release position it further permits downward movement of the data entry/interface mount.

15. The adjustment support assembly of claim 13, wherein the slide bar is pivotally coupled to the linkage assembly and the brake plate member is located in a housing, the housing being pivotally coupled to the work surface mount.

16. The adjustment support assembly of claim 13, wherein the brake plate member and a biasing member are located in a housing, the biasing member is adapted to bias the brake plate member to the clamping position, and a portion of the linkage assembly is adapted to selectively engage the brake plate member to counteract the biasing member and move the brake plate member to the release position.

17. The adjustment support assembly of claim 13, wherein the work surface mount further comprises a swivel assembly for pivotal movement of the data entry/interface mount within a horizontal plane and the swivel assembly is adapted to slidably engage a work surface mounting bracket.

18. The adjustable support assembly of claim 13, wherein the clamp assembly comprises a fastener having a longitudinal axis and passing through a portion of the data entry/interface mount and through a portion of the linkage assembly, and further comprises a rotatable knob adapted to threadably engage the fastener to apply a clamping load along the longitudinal axis of the fastener.

19. The adjustment support assembly of claim 13, wherein the clamp assembly is adapted to releasably apply a clamping load which permits relatively small pivotable movement of the data entry/interface mount about a horizontal axis through a portion of the linkage assembly.

20. The adjustment support assembly of claim 13, wherein the clamp assembly is adapted to permit selective adjustment of the angular orientation of the data entry/interface mount relative to the work surface mount by selective engagement of a clamp releasably applied to maintain the position of an axis through a portion of the linkage assembly relative to a position along an arcuate slot in the data entry/interface mount.

* * * * *